United States Patent [19]

Bykerk

[11] Patent Number: 4,551,781

[45] Date of Patent: Nov. 5, 1985

[54] CONTROL CIRCUIT FOR MAGNETIC PROBE

[75] Inventor: Rocky S. Bykerk, Newport, Wash.

[73] Assignees: Chris G. Nicholson, Richmond; J. Gid Parrish, Dekalb, both of Ga.; Ivan H. Brown, Sonoma, Calif.; Reuben H. Gordon, Richmond, Ga.

[21] Appl. No.: 519,820

[22] Filed: Aug. 3, 1983

[51] Int. Cl.[4] ..... H01H 47/32

[52] U.S. Cl. ..... 361/143; 128/1.3; 361/203; 361/208

[58] Field of Search ..... 361/143, 203, 208, 190, 361/160, 139; 128/1.3, 1.4, 1.5

[56] References Cited

FOREIGN PATENT DOCUMENTS 39206 11/1981 European Pat. Off. ..... 128/1.3

48451 3/1982 European Pat. Off. ..... 128/1.5

*Primary Examiner*—Harry E. Moose, Jr.

*Attorney, Agent, or Firm*—James B. Middleton

[57] ABSTRACT

A control circuit for a magnetic probe. A power supply connects the available power to the direct voltages required to control electronic circuitry, and a voltage required for the magnetic probe. A clock establishes a time base for the entire device. A current alternator changes the direction of current flow through the magnet to change the polarity, and a pulse rate control sets the frequency with which the polarity is changed. The current alternator is variable to allow one polarity to remain for a longer time than the other, and to vary the timing for each. The frequency of the pulsing is counted, and the particular frequency is displayed in readable form.

6 Claims, 2 Drawing Figures

CONTROL CIRCUIT FOR MAGNETIC PROBE

INFORMATION DISCLOSURE STATEMENT

It is known to use a magnetic probe for various purposes. Recently completed studies have substantiated the use of one such probe (U.S. Pat. No. 3,664,327 issued to Gordon and Brown) in muscle spasticity, hypertonicity and the like. It will be realized from that patent that the electric current to the magnetic probe should be of a desired duration and direction in order to accomplish the desired purposes. There is also a prior control circuit for a probe such as that disclosed in the above mentioned Gordon patent, one such control circuit being disclosed in U.S. Pat. No. 3,175,129 issued to Brown et al. More recently, it has become desirable to control the magnetic flux in many different ways. For example, it is desirable to control the polarity of the electromagnet, to alternate polarity at a predetermined frequency, and to achieve these controls without undue personal attention to switches or the like. As is well known to those skilled in the art, the polarity of an electromagnet is changed by reversing the direction of current flow through the coil making up the magnet; therefore, control means must be devised to cause current to flow through the magnetic coil in the desired direction in order to achieve the desired polarity.

SUMMARY OF THE INVENTION

This invention relates to control circuits, and is more particularly concerned with a control for a magnetic probe wherein the polarity of the probe is automatically switched in accordance with a predetermined pattern.

The present invention includes a power supply for converting conventionally available AC power to the plurality of DC voltages required for the magnetic probe and for the control circuit. The circuitry includes a clock for providing timed pulses, the clock pulses being fed to a duration timer. The output from the duration timer is directed to a pulse rate control means for determining the rate at which pulses of current will be passed through the probe. The output from the pulse rate control is then fed to a current alternator for changing the direction of flow of current through the probe, thereby determining the magnetic polarity of the probe. This current alternator controls a switch whereby the relatively high voltage for providing the current to the magnetic probe is switched on or off. The present invention also includes display means for indicating the frequency of pulsing of the probe. For this function, a signal from the current switch to the probe is fed to a frequency counter, the frequency counter also receiving a time base from the clock. The frequency counter counts the pulses, determines the frequency, and drives a display for indicating the particular frequency. In one embodiment of the invention, there are two separate probes, and one power supply and clock is utilized for both probes, but the other control circuitry is duplicated for the second probe.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
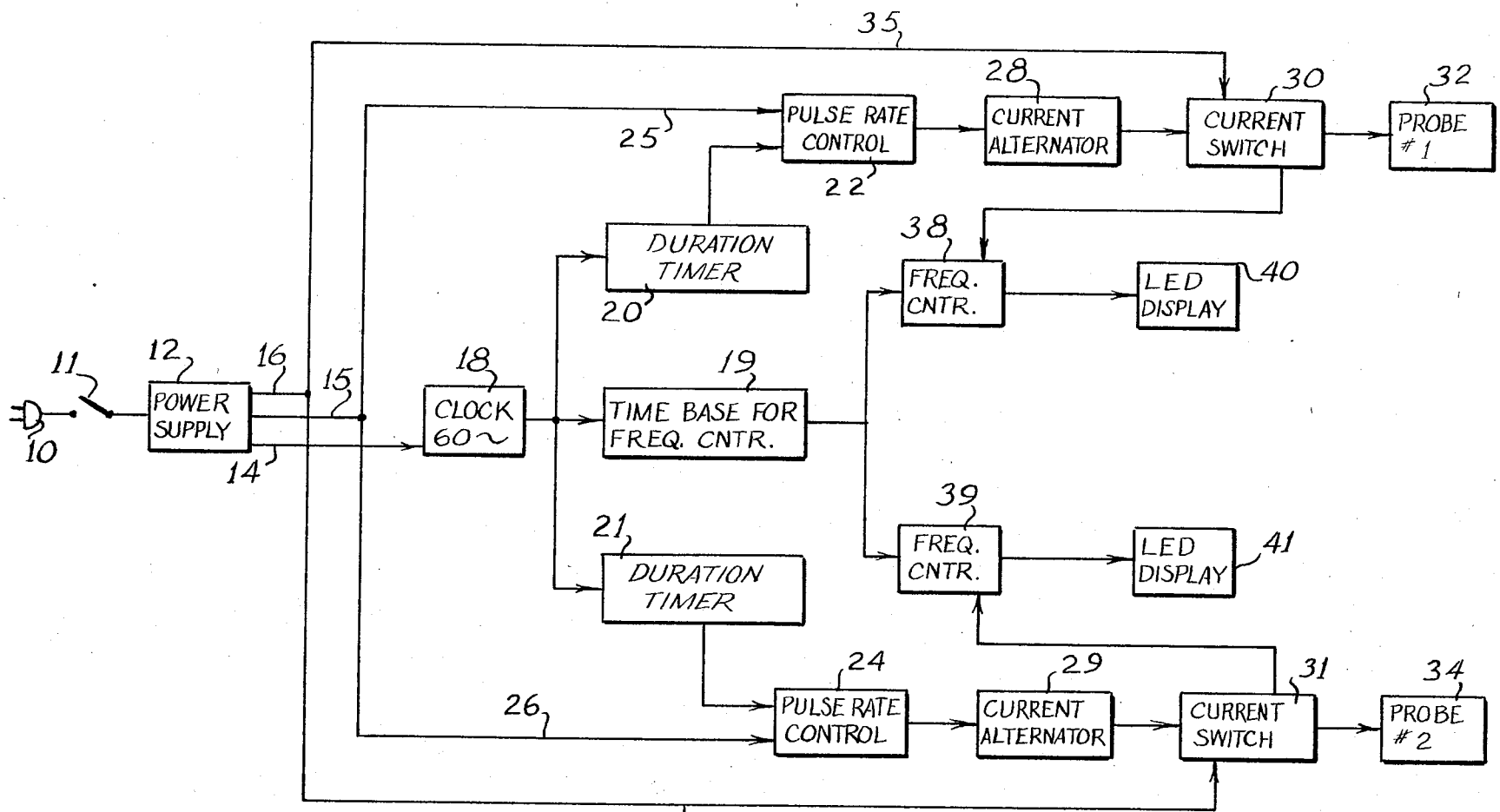
FIG. 1 is a block diagram showing the function of a device made in accordance with the present invention, the diagram of FIG. 1 showing two probes with the dual control circuitry; and, FIG. 2 is a schematic circuit diagram showing control circuitry for one of the probes.

Referring now more particularly to the drawings, and to that embodiment of the invention here presented by way of illustration, it will be seen in FIG. 1 that a source of an AC voltage is indicated at 10, the power being supplied through a power switch 11 to a power supply 12. Those skilled in the art will readily devise any number of power supplies, it being understood that the apparatus as herein disclosed requires a relatively stable, direct voltage power supply to supply the various voltages required by the other portions of the circuitry. One successful embodiment of the invention requires 5 volts, 12 volts and 110 volts, and there are indicated by the lines 14, 15 and 16.

The line 14, which is the 5 volt supply, is directed to the clock 18 which provides a 60 cycle per minute pulse as a time base for use in the rest of the circuitry. It will be seen that the output from the clock 18 is directed to the device 19 which provides a time base for a frequency counter. This will be discussed in more detail hereinafter.

The clock 18 also provides pulses to duration timers indicated at 20 and 21. These two duration timers 20 and 21 are identical, but two are required because of the two probes to be controlled. As will be discussed in more detail hereinafter, the duration timers 20 and 21 determine the length of time the current flows in one direction, which is to say that it determines the length of time the electromagnet has a given polarity.

An output from the duration timers 20 and 21 is fed to the pulse rate control means 22 and 24. Again, the pulse rate controls 22 and 24 are identical, each serving one of the two probes. The pulse rate controls 22 and 24 also receive input from the lines 25 and 26 which are connected to the line 15 for the 12 volt supply. From the pulse rate controls 22 and 24, a signal is fed to the current alternators 28 and 29. The current alternators determine the direction of flow of current through the probes, and change the direction of flow in accordance with the predetermined pattern. The current alternators 28 and 29, then, direct a signal to the current switches 30 and 31 which act as switches to the probes 32 and 34. It will be seen that the 110 volt line 16 is directed through lines 35 and 36 to the current switches 30 and 31 so the appropriate power can be directed to the probes 32 and 34. Also, a signal from the current switches 30 and 31 is directed to the frequency counters 38 and 39. The frequency counters 38 and 39 utilize the time base from the device 19, impose the information from the current switches 30 and 31, and determine the frequency of alternation of current, hence alternation of probe polarity. When the frequency is determined, the frequency is displayed on the LED displays 40 and 41.

It will therefore be seen that the present invention provides two magnetic probes 32 and 34, each probe having power supplied from the 110 volt line 16, through the switches 30 and 31 and to the probes 32 and 34. The current switches 30 and 31 are controlled from the current alternators which give the operator a choice of providing a fixed polarity, an alternating polarity, or an alternating polarity having one polarity for a greater length of time than the other.

Figure 2:
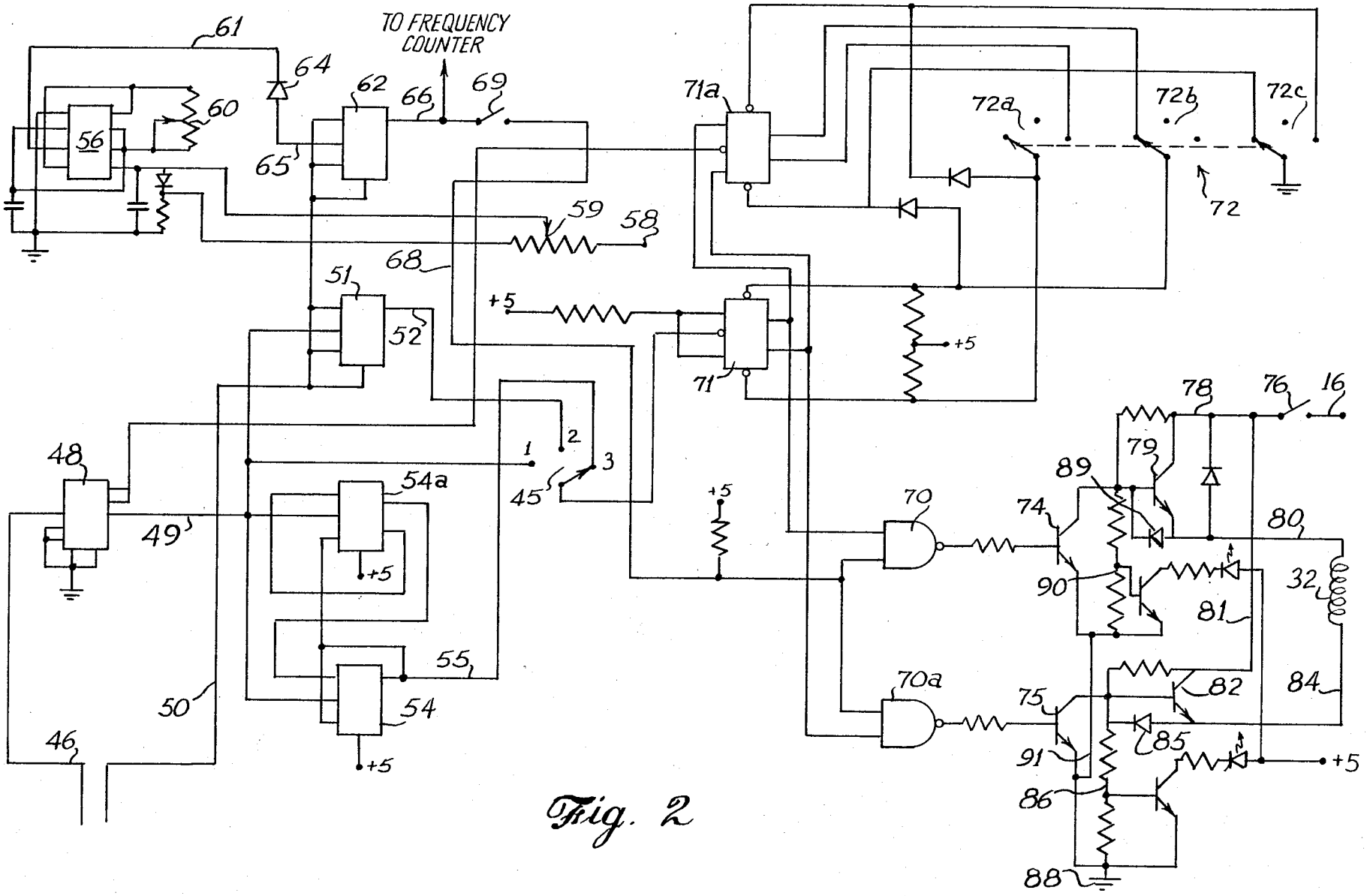

Attention is next directed to FIG. 2 of the drawings where there is shown a selector switch 45 for selecting, in one embodiment, a one second, two second or three second altering duration. A line 46 leads to the time base, such as the clock 18, to a decade counter 48. It will be understood that the counter 48 receives the clock pulses and makes an appropriate division so that pulses are emitted on the line 49 each second, so that if the switch 45 has the selector on the terminal numbered 1, a one second rate has been selected.

The line 50 is also connected to a time base, such as the clock 18, and is directed to the circuit device 51. The circuit device 51 is a conventional arrangement including dual flip-flops arranged in a single package, and such a device is well known to those skilled in the art. The circuit device 51 is arranged so that, with the input of the clock pulses along the line 50, a pulse will be emitted along the line 52 at the rate of one pulse every two seconds. As a result, if the selector of the switch 45 is on the terminal numbered 2, the pulse rate will be two seconds.

Finally, the circuit device 54 is also a dual flip-flop, and is here shown in two pieces indicated at 54 and 54*a*. The device is shown in two separate rectangles for convenience, and it will be seen that the device receives the one-second pulses from the line 49, and it will be understood that a pulse is emitted on the line 55 at the rate of one every three seconds. It will therefore be seen that, when the selector of the switch 45 is on the terminal numbered 3, the pulse rate is one every three seconds.

Attention is next directed to the circuit device designated at 56. The device 56 is an integrated circuit used as a voltage controlled oscillator. The control for the voltage controlled oscillator 56 is by means of the connection at 58 to the 12 volt supply line 15 which is connected to a potentiometer indicated at 59. Since the frequency of the oscillator 56 is controlled by the voltage, it will be understood that the setting of the potentiometer 59 will determine the frequency of oscillation. The high limit of the oscillator 56 is controlled by the potentiometer 60.

It will be seen that there is a line 61 connected to the circuit device 62 through a diode 64. The circuit device 62 is a dual flip-flop; therefore, it will be understood that the oscillations of the oscillator 56 will determine how often the terminal 65 of the circuit device 62 is at a high potential, and how often the terminal 65 is at a low potential.

The variations of high and low potential on the terminal 65, in conjunction with clock pulses through the line 50, can result in pulses through the terminal 66. These pulses can be directed through the line 68 when the switch 69 is closed, the line 68 being connected to the NAND gate indicated at 70 and 70*a*. The NAND gate 70 and 70*a* is a single device having four terminals, but amounting to two, two-input NAND gates.

The NAND gate 70 and 70*a* is also connected to the circuit devices 71 and 71*a*. The circuit device 71 and 71*a* is, again, a single device here shown in two portions for simplicity of illustration. The device 71 and 71*a* is a dual flip-flop which will be well understood by those skilled in the art. There is a three-pole selector switch indicated at 72, the three poles being designated at 72*a*, 72*b* and 72*c*. It will be seen from the circuitry shown that, depending on the position of the selector switch 72, and the NAND gate 70 and 70*a* will provide high potentials to the bases of the transistors 74 and 75.

The probe 32 is indicated as a coil, and the 110 volt supply is indicated at 16 since this supply would come from the line 16 of the power supply 12. The switch 76 will be closed to activate the probe 32; and, when the switch 76 is closed, current will flow either through the line 78, through the transistor 79 and to the line 80 to pass through the probe 32; or, current will pass through the switch 76, through the branch 81 and through the transistor 82, then to the line 84 and to the probe 32.

From the foregoing, it will be understood that, when the base of the transistor 75 has the appropriate potential to provide a complete circuit through the emitter-collector circuit, the transistor 79 will allow current to flow from the line 78, through the transistor 79 and to the line 80, then through the coil 32, through the line 84, thence through the diode 85, and through the transistor 75 to ground at 88.

Conversely, when the transistor 74 has the appropriate potential applied to its base to cause the emitter-collector circuit to conduct, the transistor 82 will allow current to flow through the switch 76, through the line 81 and through the transistor 82, then through the line 84 and through the probe 32, thence through the line 80, through the diode 89, then through the transistor 74, through the connector 91, then to the ground 88. It will therefore be seen that, depending on which of the transistors 74 and 75 is biased on determines the direction of current flow through the probe 32. Since the direction of current flow determines polarity of the magnet, the selecting of the transistor 74 or 75 determines the polarity of the magnetic probe 32.

From the foregoing discussion, it should now be understood by those skilled in the art that clock pulses are established and utilized to set forth a one-second, two-second and three-second time pulse. These are fed to the current alternator 28, which is also to the circuit devices 71 and 71*a*. Also, there is a voltage controlled oscillator 56 to establish a pulse rate, the pulse rate being imposed on the clock pulses. The result of the voltage controlled oscillator as modified by the clock pulses is fed to a NAND gate, the NAND gate having other inputs from the dual flip-flop 71. The one-, two- and three-second pulses are fed to the dual flip-flop 71, the clock pulses are fed through the one-second timer to the dual flip-flop 71, and selector switches 72 are additionally provided giving a high, a low, or an alternating potential. This combination allows very wide selection of pulses to the four-input NAND gate 70 to accomplish an alternating output from the NAND gate 70, a steady output from the NAND gate 70, or an alternating output with one-half of the NAND gate 70 being held for a longer period of time than the other. The output from the NAND gate 70 determines the direction of flow of current through the probe 32, or through an electromagnet, so that biasing the NAND gate 70 appropriately determines the polarity of the probe 32, and the duration of a given polarity of the probe.

In view of the foregoing description, it should be understood by those skilled in the art that the apparatus of the present invention provides great flexibility in the energization of the electromagnets, or probes 32 and 34. While specific voltages and the like have been discussed herein by way of illustration, those skilled in the art will also understand that conventional circuit devices may utilize different voltages, and have other characteristics requiring a slightly different arrangement, and variation to achieve the functions herein described will be well within the ability of the person of ordinary skill in the art.

It will therefore be understood that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A magnet control circuit comprising a power supply, clock means for providing pulses at a fixed rate, first dividing means for dividing said fixed rate and providing a first pulse rate, second dividing means for dividing said fixed rate and providing a second pulse rate, selector switch means selectively connectable for receiving said first pulse rate and said second pulse rate, a coil constituting said magnet, a first transistor connected to one side of said coil, a second transistor connected to the opposite side of said coil, gate means for selectively causing said first transistor to conduct for connecting said one side of said coil to ground, said opposite side of said coil being connected to a positive voltage from said power supply, and for selectively causing said second transistor to conduct for connecting said other side of said coil to ground, said one side of said coil being connected to a positive voltage from said power supply, and circuit means for selectively connecting said selector switch to said gate means.

2. A magnet control circuit as claimed in claim 1, said gate means having a plurality of inputs, a variable frequency oscillator, at least one input of said plurality of inputs being from said oscillator.

3. A magnet control circuit as claimed in claim 2, said circuit means including alternator means, a switch for varying said alternator means, said plurality of inputs to said gate means being controlled by said alternator means.

4. A magnet control circuit as claimed in claim 3, said gate means comprising a dual NAND gate, triggering of one gate portion of said dual NAND gate causing operation of said first transistor, and triggering of the other gate portion of said dual NAND gate causing operation of said second transistor.

5. A magnet control circuit as claimed in claim 4, said first transistor having an emitter connected to said ground and a collector connected to said one side of said coil, said second transistor having an emitter connected to said ground and a collector connected to said other side of said coil, a first diode connected between said other side of said coil and said second transistor, and a second diode connected between said one side of said coil and said first transistor.

6. A magnet control circuit as claimed in claim 5, and further including frequency counting means for counting pulses from said oscillator directed to said gate means, and display means for displaying the frequency.

* * * * *